United States Patent [19]

Johansson

[11] 3,977,466

[45] Aug. 31, 1976

[54] ROOM AIR CONDITIONING APPARATUS

[75] Inventor: Sven-Olof Johansson, Marsta, Sweden

[73] Assignee: Aktiebolaget Carl Munters, Sollentuna, Sweden

[22] Filed: Mar. 22, 1974

[21] Appl. No.: 453,771

[30] Foreign Application Priority Data

Mar. 30, 1973 Sweden ..... 7304553

[52] U.S. Cl. ..... 165/40; 165/7; 165/59; 165/DIG. 12; 62/331; 98/33 R; 98/116

[51] Int. Cl.[2] ..... F28D 19/00

[58] Field of Search ..... 165/7, 10, 59, DIG. 12, 165/40; 98/116, 33 R; 62/331; 417/300

[56] References Cited

UNITED STATES PATENTS

| | | | |
|---|---|---|---|
| 2,792,071 | 5/1957 | Pennington | 165/7 X |
| 3,158,082 | 11/1964 | Dillingham et al. | 98/116 X |
| 3,165,625 | 1/1965 | Potter | 165/59 X |
| 3,402,654 | 9/1968 | Berst | 98/33 R |
| 3,611,906 | 10/1971 | Lorenz | 98/33 R |
| 3,698,472 | 10/1972 | Gold et al. | 165/6 |

*Primary Examiner*—Albert W. Davis, Jr.
*Attorney, Agent, or Firm*—Eric Y. Munson

[57] ABSTRACT

A room air conditioning apparatus for exchanging heat and/or moisture between fresh atmospheric air entering the room from the outside and consumed air being discharged from the room combines high capacity with relatively small dimensions, low air velocities and small pressure drops so as to minimize generation of disturbing noise. Within a casing, a motor-driven regenerative-type rotor passes through two air stream zones in the first of which is a motor-driven fan for discharge of consumed room air into the outer atmosphere and in the second of which is a motor-driven fan for supply of fresh air to the room from the outer atmosphere. In the rotor, the two air streams exchange heat and/or moisture content so that the supply of fresh air is given a desired, predetermined temperature and a desired moisture content. The quantities of entering and discharged air are maintained approximately equal to obtain good heat economy and ventilation through the provision of means which sense and balance the two air streams to maintain the same at predetermined quantities irrespective of pressure changes external to the air conditioning apparatus due to atmospheric forces such as wind. These means may include either pressure, velocity or temperature sensing means located within the air stream zone which sense the same and cause the motor-driven fans therein to increase or decrease air flow in response thereto.

6 Claims, 3 Drawing Figures

ROOM AIR CONDITIONING APPARATUS

FIELD OF THE INVENTION

This invention relates to a room air conditioning apparatus.

More particularly this invention relates to an apparatus intended for conditioning the air in a room. Said apparatus is devised to be mounted on the wall of the room, preferably adjacent a window, and comprises a rotor driven by a motor and composed of a mass forming a plurality of axially channels extending from end to end, a first motor-driven fan for discharging consumed room air from the room through a zone of the rotor to the outer atmosphere, a second motor-driven fan for supply of fresh air from the outer atmosphere through a second zone of the rotor to the room to be conditioned and filter means for cleaning the two air streams prior to their passage through the rotor. The mass of said rotor is preferably made of a material possessing hygroscopic properties.

MAIN OBJECTS OF THE INVENTION

One object of the invention is to provide an apparatus of the kind defined hereinbefore which forms a unit especially suited for ventilation of individual business or dwelling rooms or a minor number thereof and which to advantage can be mounted adjacent a window.

Another object of the invention is to provide a room air condition apparatus unit which combines great capacity with relatively small dimensions, low air velocities and as a consequence small pressure drops so as to minimize generation of disturbing noise.

MAIN FEATURES AND ADVANTAGES OF THE INVENTION

According to a main feature of the invention a box-shaped casing encasing all above mentioned parts of the apparatus is subdivided by vertical walls into three chambers, the central of said chambers housing the rotor in front of an opening formed in the room wall and the two fans positioned in the chambers on either side of said central chamber, the filter means disposed ahead of said first fan being located in the lower part of the casing below said chambers and the second filter means for the other air stream between said rotor and said room wall opening.

The various parts of the apparatus have an advantageous position relative one another and the opening formed in the room wall so that the spaces in the apparatus are utilized in the most favourable manner to obtain maximum quantities of air passing through the apparatus per unit time with low velocity and at a very low noise level as a desirable result thereof.

Further objects, features and advantages of the invention will become apparent from the following description, considered in connection with the accompanying drawings, which form part of this specification, and of which:

THE DRAWINGS

FIG. 1 is a perspective view of an apparatus built according to principles of the invention.

FIG. 1*a* is a schematic view showing the control system for the sensors

FIG. 2 is a vertical sectional view of a wall of a room and the apparatus mounted thereon.

DETAILED DESCRIPTION OF THE PREFERRED EMBODIMENT

Figure 1:
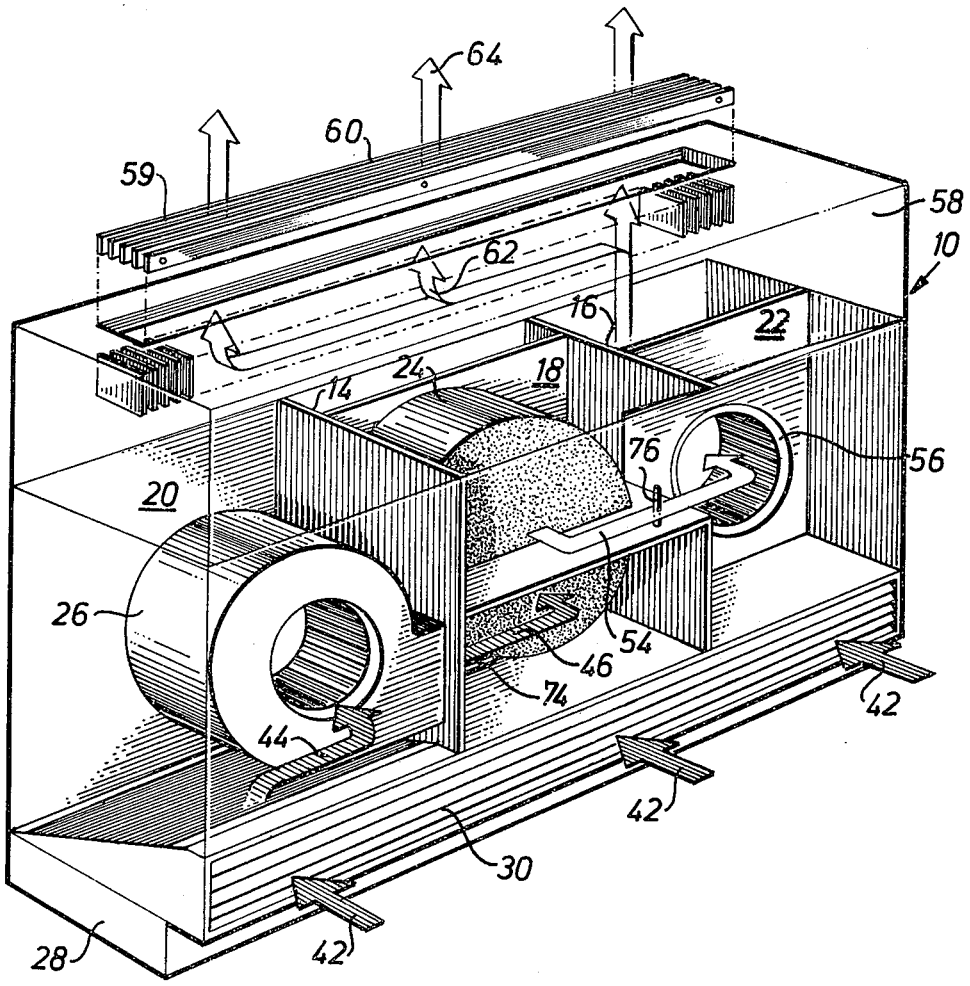

Referring now to the drawings, reference numeral 10 denotes the external casing of the air conditioning apparatus. Said casing has the shape of an elongated box the walls of which stand perpendicularly relatively one another. The casing which is intended to be mounted on a wall 12 of a room or space to be conditioned, suitably below a window opening in said wall, has its greatest extension in horizontal direction and may have an inner noise suppressing lining 15. The interior of the casing is subdivided by means of partition walls 14, 16 into three chambers, namely a central chamber 18 and on either side thereof located chambers 20, 22. Mounted in the central chamber 18 about horizontal pivots is a heat and moisture exchanging rotor 24 which is driven by a motor (not shown). The rotor 24 is in known manner composed of thin layers of e.g. asbestos which are alternately plane and corrugated and which form axial channels extending from end to end between the two plane front sides of the rotor. The asbestos layers are impregnated with a hygroscopic substance such as lithium chloride and may otherwise be formed and manufactured in the manner described e.g. in the U.S. Pat. No. 3,231,409.

Figure 2:
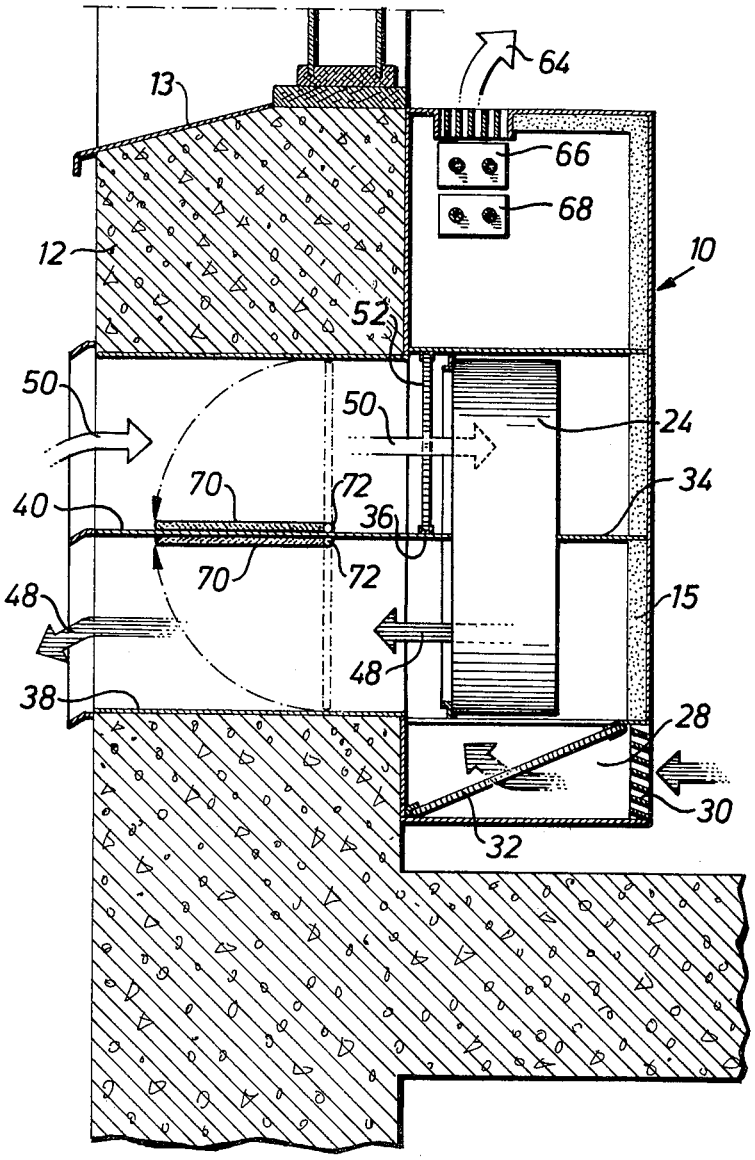

Provided in the chamber 20 is a fan 26 of a type known per se and connected with a driving motor. Below all chambers 18, 20, 22 there extends a space 28 which through an elongated opening 30 provided with a grating communicates with the interior of the room to be conditioned. Positioned in the space 28 is a filter 32 which has to its purpose to clean the consumed air to be discharged from the room from entrained particles so that these do not follow the air into the free channels of the rotor 24. This filter extends along the entire space 28 and has an inclined position to the horizontal plane as especially shown in FIG. 2 so as diagonally to divide the space 28 into approximately equal parts. The space 28 communicates only with the chamber 20 into which the air to be discharged is sucked through the central inlet side of the fan 26, the discharge side of said fan communicating with a lower zone of the rotor 24 which is located in a passage limited in upward direction by walls or partitions 34, 36. Formed in the room wall 12 is a preferably circular opening 38 which in the same manner as the chamber 18 is subdivided by a horizontal partition wall 40 which in turn is a continuation of the horizontal partition wall 36. The consumed air departing from the room escapes according to the arrows 42, 44, 46 and 48 out into the surrounding free atmosphere, the air under this passage streaming through the lower half section of the rotor 24.

Through the upper half of the room wall opening 38 fresh atmospheric air is introduced. Said air streams through the upper passage of the central chamber 18 and the upper zone located therein of the rotor 24 as indicated by the arrows 50. On its way the air passes through a filter means 52 of the same kind as the filter 32 so that particles following with the air are separated off and prevented from depositing in the fine channels of the rotor 24. The two zones of the rotor have the same or approximately the same fronter area. As indicated by the arrow 54 the fresh air continues its flow to the inlet side of a motor-driven fan 56 located in the upper chamber 22 according to FIG. 1 and therefrom into an upper space 58 which extends over all three chambers 18, 20, 22 but communicates with the chamber 22 only. The entering fresh air is distributed over said space and is discharged through an opening 60 covered by a grating 59 in the direction of flow indicated by arrows 62 and 64 respectively.

During the passage through the rotor 24 the two air streams exchange heat and moisture content, so that in winter time the escaping or discharged air stream heats the entering air while simultaneously moisture is transferred from the former air stream to the latter one, thus preventing desiccation of the air in the room. Provided in the space 58 may be a heater 66 which heats the entering air to a slightly higher temperature than that prevailing in the room in order to replace heat losses. Otherwise also the efficiency of the apparatus is very high, such as from 75 to 85 per cent or even higher. The apparatus may also be provided with a cooler as is indicated at 68, so that the entering air during the summer season is cooled to lower temperature than that prevailing in the room. During that season of the year, the outer air may contain more moisture than the room air, the apparatus thus preventing moisture from being transferred into the room or rooms to be conditioned.

As already stated the interior of the room communicates through the room wall opening 38 with the outer atmospheric air. In order now to avoid air exchange when the apparatus is out of operation, there may be provided in the opening 38 valves such as two screens 70 which are pivotable about an associated shaft 72 and which in the position indicated by dashes according to FIG. 2 close one half each of the opening 38. These valves may be coordinated with the electrical system for the apparatus so that they are forced automatically to take closing position when the supply of current to the motor of the fans or the rotor itself is interrupted.

OTHER FEATURES AND EMBODIMENTS OF THE INVENTION

In order during operation to attain as good heat economy and ventilation as possible, the quantities of entering and discharged air must be approximately equally great, which thus means that the air exchange in the rooms is effected by replacing the consumed air by the same quantity of fresh air. It has now proved that the balance between the two air streams is depended on the force and the direction of the wind active in the atmospheric air relative that room wall side where the apparatus is mounted and that hereby disturbances may be caused which jeopardize the correct operation of the apparatus. On that side of a house which in a gale is hit by the wind an increased pressure is developed which is added to the pressure produced by the fan 56 for the incoming fresh air so that a greater quantity of fresh air is introduced into the room. On the other hand the stream of discharged or escaping air is exposed to a counterpressure which reduces the quantity of escaping air. The result will become in winter time that the entering or fresh air is given lower temperature than normally, since the quantity of air discharged at the same time is not sufficient for the intended heat exchange. In summer time it may happen that the entering air is not cooled down to desired degree so that the temperature in the room rises over the predetermined one. At the lee side of the house the state of things is reversed as much as the quantity of discharged air becomes greater than the normal quantity since the reduced pressure prevailing at the lee side is added to the suction action of the fan 26 for discharged air. At the same time a reduced quantity of fresh air is delivered to the room to be air conditioned. A deficit of air appears therein which must be taken from adjacent spaces such as corridors or the like spaces which results in that the ventilation becomes faulty. This inconvenience becomes especially prominent by the fact that the pressure drops produced by the fans must be kept at a low value such as 5 to 10 mms water column and still lower to avoid any disturbing noise. These small pressure drops become thus especially sensitive to disturbances, when the wind causes pressure differences between the outer atmospheric air and the interior of the house in which the apparatuses are installed.

According to a particularly advantageous feature of the invention the room air conditioning apparatus is fitted with means adapted to counteract such wrong proportions between introduced and discharged air. For this purpose a feeler 74, 76 may be provided in each passage through the apparatus which scans the pressure drop therein and emits an impulse to a regulator for the number of revolutions of the fan which reduces the number of revolutions of the fan in that air stream which due to occurring strong outdoor wind is increased over a predetermined average value whereas the feeler scanning the other air stream emits an impulse for increase of the number of revolutions of the fan and therewith the air quantity supplied by said fan.

Figure 1A:
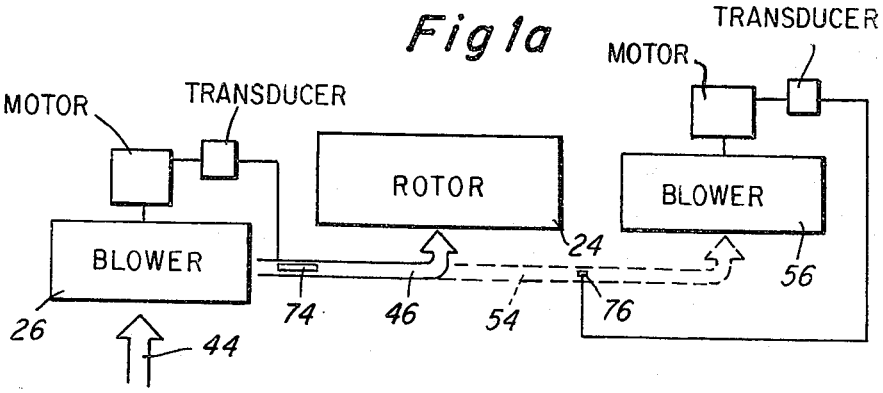

According to another embodiment of this feature the feelers 74 and/or 76 may be a temperature transmitter means which may be adjusted to an increased temperature over a predetermined room temperature and which varies the number of revolutions of the fans when it is exposed for the cooling effect of the air streams in response to their velocity. The control system from the feeler 74 and 76 is shown diagrammatically in FIG. 1*a*.

The feelers may to advantage be positioned in the passage for the stream of discharged air prior to the passage of said air stream through the rotor and in the entering air stream behind the rotor in order to the lowest possible degree become dependent on the variations of the temperature of the outer atmosphere. The temperature inside the room is usually approximately constant with relatively low deviations in both directions.

Still a possibility is to scan the air velocity in the passages and in response thereto to control the number of revolutions of the fans. The adjustment of the mutual relations between the air quantities passing through the apparatus for compensation of the effect of the wind pressure is not bound to that specific type of air conditioning apparatus which has been described above with reference to the accompanying drawings.

While several more or less specific embodiments of the invention have been shown and described it is to be understood that this is for purpose of illustration only, and that the invention is not to be limited thereby but its scope is to be determined by the appended claims.

The embodiments of the invention in which an exclusive right or privilege is claimed, are defined as follows:

1. In a room air conditioning apparatus for exchanging heat and/or moisture between fresh atmospheric air entering the room from without and consumed air being discharged from the room including an exchanger body having a first zone forming a passage for an entering air stream and a second zone forming a passage for a discharging air stream and fan means for forcing the air streams to pass through their respective zones, the improvement permitting more effective low air velocity operation with consequent low pressure drops and reduced generation of noise comprising means positioned in each zone for determining the quantity of air passing through each zone and causing the fan means to operate in response to such determination upon divergence of the quantity from a predetermined value to restore the quantity to the predetermined value.

2. An improved air conditioning apparatus as claimed in claim 1 wherein the means for determining the quantity of air comprises means for sensing a change in the pressure in each zone.

3. An improved air conditioning apparatus as claimed in claim 1 wherein the means for determining the quantity of air comprises means for sensing a change in the temperature of the air stream in each zone.

4. An improved air conditioning apparatus as claimed in claim 1 wherein the means for determining the quantity of air comprises means for sensing a change in the velocity of the air stream in each zone.

5. An improved air conditioning apparatus as claimed in claim 1 wherein the means causing the fan means to operate comprises means for emitting an impulse to a regulator controlling the number of revolutions of the fan means to increase or decrease the number of revolutions of the fan means in response to the air quantity divergence determination to restore the air quantity to the predetermined value.

6. An improved air conditioning apparatus as claimed in claim 1 wherein the exchanger body is of the regenerative, motor-driven type and passing through both zones and the means for determining the quantity of air is located in those portions of the zones which are on the room side of the exchanger body.

* * * * *